US006290557B1

(12) United States Patent
Yokoya

(10) Patent No.: US 6,290,557 B1
(45) Date of Patent: Sep. 18, 2001

(54) EXHAUST SYSTEM FOR JET PROPULSION BOAT

(75) Inventor: Noboru Yokoya, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/536,381

(22) Filed: Mar. 28, 2000

(30) Foreign Application Priority Data

Mar. 29, 1999 (JP) ..... 11-087268

(51) Int. Cl.[7] ..... B63H 21/38
(52) U.S. Cl. ..... 440/89; 181/232
(58) Field of Search ..... 440/89, 38, 40–42; 181/232, 235, 212, 228, 279

(56) References Cited

U.S. PATENT DOCUMENTS 4,713,029 * 12/1987 Ford ..... 440/89
5,196,655 * 3/1993 Woods ..... 181/235
5,746,630 * 5/1998 Ford et al. ..... 440/89
5,824,972 * 10/1998 Butler ..... 181/279
6,071,156 * 6/2000 Platzer et al. ..... 440/42

FOREIGN PATENT DOCUMENTS

A8119196 5/1996 (JP) .

* cited by examiner

*Primary Examiner*—Sherman Basinger
(74) *Attorney, Agent, or Firm*—Birch, Stewart, Kolasch & Birch, LLP

(57) ABSTRACT

An exhaust system for a jet propulsion boat and a jet propulsion boat including the exhaust system. The exhaust system includes a muffler connected to the boat's engine by an exhaust pipe, and an auxiliary muffler connected to the muffler by a first connecting portion of a connecting pipe, A second connecting portion of the connecting pipe connects the auxiliary muffler to a tail pipe, through which exhaust gases travel to be exhausted into the water through a nozzle of a jet propulsion device. The auxiliary muffler is elevated with respect to the connecting pipe, which prevents the entry of water into the auxiliary muffler and a corresponding degradation of its sound reduction capability.

18 Claims, 8 Drawing Sheets

EXHAUST SYSTEM FOR JET PROPULSION BOAT

BACKGROUND OF THE INVENTION

1. Field of the Invention

The present invention relates to an exhaust system for a jet propulsion boat that exhausts engine exhaust gas into water.

2. Background Art

A jet propulsion boat is known in which a rider rides a saddle-type seat, and controls the vehicle by a steering handlebar having an accelerator lever on a right end portion of the steering handlebar, and a decelerator lever on a left end portion of the steering handlebar. An exhaust system for a conventional jet propulsion boat, an "Engine Exhaust system of Small-Sized Ship," is described in Japanese Unexamined Patent Publication No. 8-119196. This type of exhaust system will be described with reference to FIGS. 8 and 9 of this application.

FIG. 8 is a plan view of a conventional exhaust system for a jet propulsion boat. An engine 101 is mounted below a steering handlebar 100, an impeller (not illustrated) of a jet propulsion device is attached to a drive shaft 102 extending rearwardly from engine 101, and an exhaust system 105 is provided at the engine 101.

An exhaust pipe 106 extends rearwardly from a left side portion of the engine 101, and a muffler is connected to an outlet of the exhaust pipe 106 arranged on the left side of the jet propulsion device 103. A connecting pipe 108 having an inverse U shape is connected to an outlet of the muffler 107 and extends to the right side by passing over the jet propulsion device 103. An auxiliary muffler 109 is connected to an outlet of the connecting pipe 108 and is arranged on the left side of the jet propulsion device 103. An exhaust pipe 110 is connected to an outlet of the auxiliary muffler 109.

The jet propulsion boat is propelled by jetting water sucked from a hull bottom rearwardly from a nozzle 112 by rotating the impeller of the jet propulsion device 103 by the engine 101. Exhaust gas from the engine 101 is exhausted from the exhaust pipe 110 into a casing of the jet propulsion device 103 by flowing through the exhaust pipe 106 to the muffler 107. The gas then flows from the muffler 107 through the connecting pipe 108 to the auxiliary muffler 109, then out the exhaust pipe 110.

FIG. 9 is a sectional view taken along a 9—9 line of FIG. 8. FIG. 9 shows the muffler 107 and the auxiliary muffler 109 respectively arranged at portions 113 and 114 of the hull bottom on the left side and the right side of the jet propulsion device. The muffler 107 and the auxiliary muffler 109 are connected by the connecting pipe 108 having an inverse U shape.

The height H of a top portion 108*a* of the connecting pipe 108 can be made sufficiently high to prevent water from accidentally entering the muffler 109 from crossing over the connecting pipe 108 and entering the engine 101. Accordingly, the connecting pipe 108 is generally referred to as a water lock pipe.

However, since the auxiliary muffler 109 is attached between the connecting pipe 108 and the exhaust pipe 110, when water enters the exhaust pipe 110 and an exhaust port of the exhaust pipe 110, there is the concern that water which has entered the exhaust pipe 110 may also enter the auxiliary muffler 109.

When water enters the auxiliary muffler 109 and the volume of the auxiliary muffler 109 is reduced, the noise reduction capacity of the auxiliary muffler is deteriorated, and exhaust noise increases.

It therefore is an object of the present invention to provide an exhaust system capable of sufficiently reducing exhaust noise.

SUMMARY OF THE INVENTION

In order to resolve the above-described problem and to achieve other advantages not present in conventional exhaust systems, there is provided an exhaust system in a jet propulsion boat. The jet propulsion boat has a jet propulsion device for jetting water sucked from a hull bottom rearward, and an engine for driving the jet propulsion device. A muffler is connected to the engine by an exhaust pipe. A connecting pipe having an inverse U shape extends from either side of an auxiliary muffler, with the auxiliary muffler located at the highest point along the connecting pipe.

In this configuration, when water enters the exhaust pipe, the water is blocked by the connecting pipe and does not enter the auxiliary muffler attached to the top portion of the connecting pipe. Water is therefore not stored in the auxiliary muffler and the noise reduction capacity of the auxiliary muffler is not reduced.

The auxiliary muffler is a horizontal cylinder type muffler, both ends of a cylindrical body of which being closed by lid plates. A pair of the lid plates are provided with an exhaust inlet and an exhaust outlet, and levels of a bottom of the exhaust inlet and a bottom of the exhaust outlet are substantially coincident with a level of a bottom of the cylindrical body.

Accordingly, when water accidentally enters the auxiliary muffler, water is not stored in the cylindrical member because water exits the cylindrical member via the exhaust inlet and the exhaust outlet. The noise reduction capacity of the auxiliary muffler is therefore unaffected.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING FIGURES

The present invention will become more fully understood from the detailed description given hereinbelow and the accompanying drawings which are given by way of illustration only, and thus are not limitative of the present invention, and wherein.

Figure 6A:
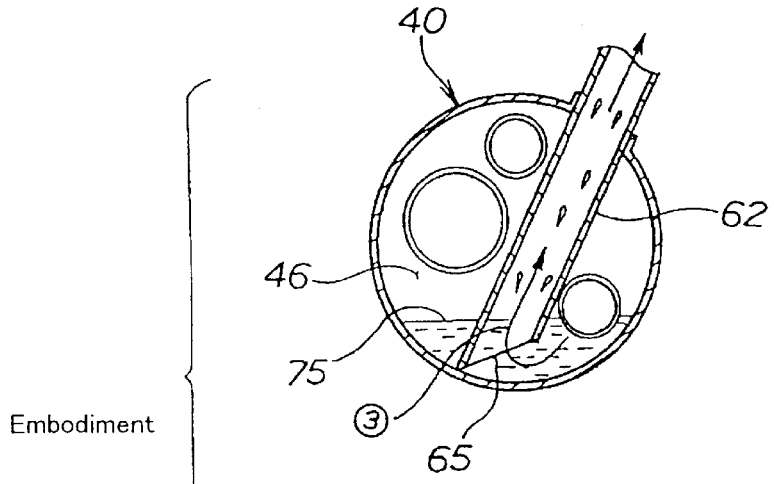
Figure 6B:
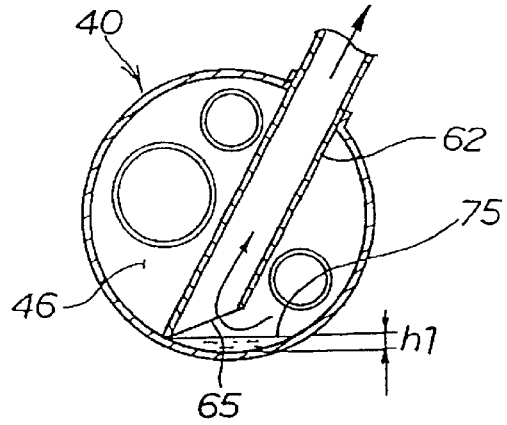
Figure 6C:
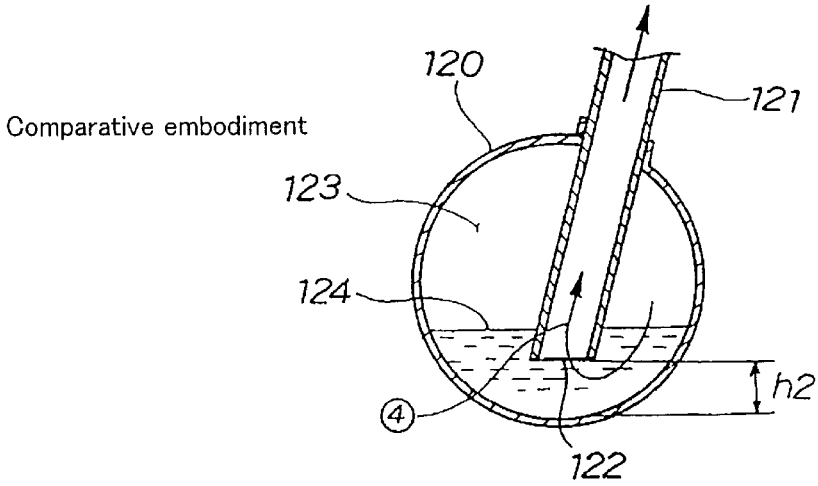
Figure 7:
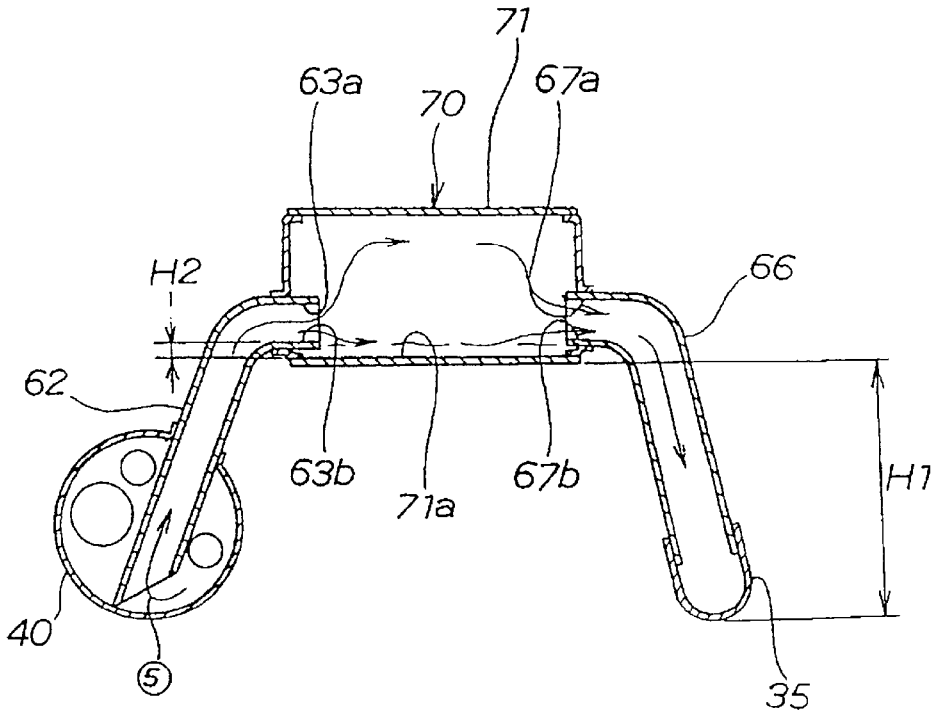
Figure 8:
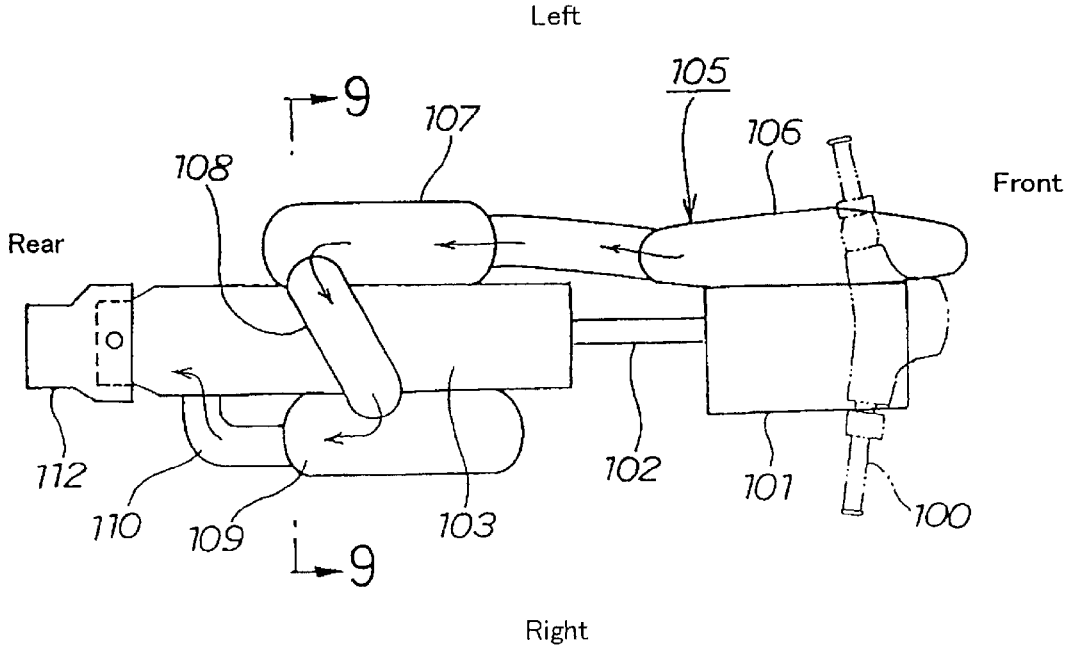
Fig. 8 PRIOR ART

FIGS. 6(*a*) and 6(*b*) are views of an operational feature of the exhaust system according to the present invention;

FIG. 6(*c*) is a comparative example of the operation of an exhaust system;

FIG. 7 is a view of an operational feature of the exhaust system according to the present invention;

FIG. 8 is a plan view of a conventional exhaust system; and

Figure 9:
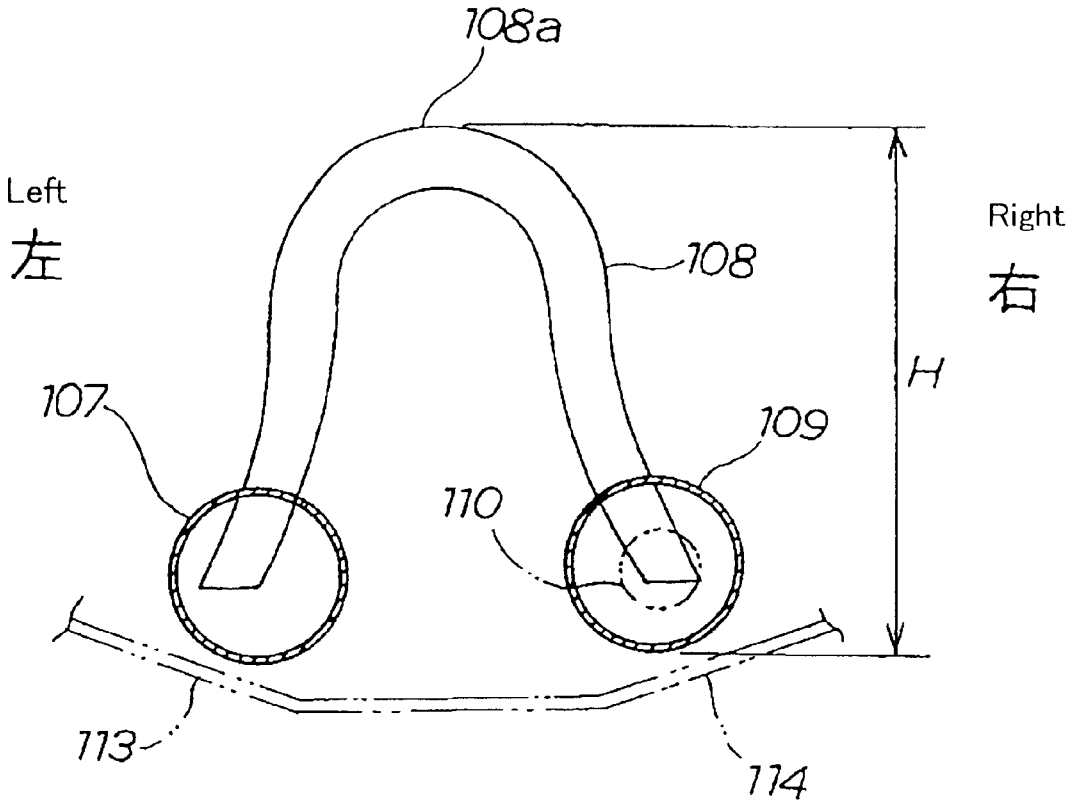
Fig. 9 PRIOR ART

FIG. 9 is a sectional view taken along line 9—9 in FIG. 8.

DETAILED DESCRIPTION OF THE PREFERRED EMBODIMENTS

In order to facilitate description of the present invention, the terms "uppermost," "higher," "above" and variations thereof are used with reference to the water surface when the jet propulsion boat is generally upright on a level water surface. The terms "front," "rear," "left" and "right" are determined from the perspective of a rider of the jet propulsion boat.

Figure 1:
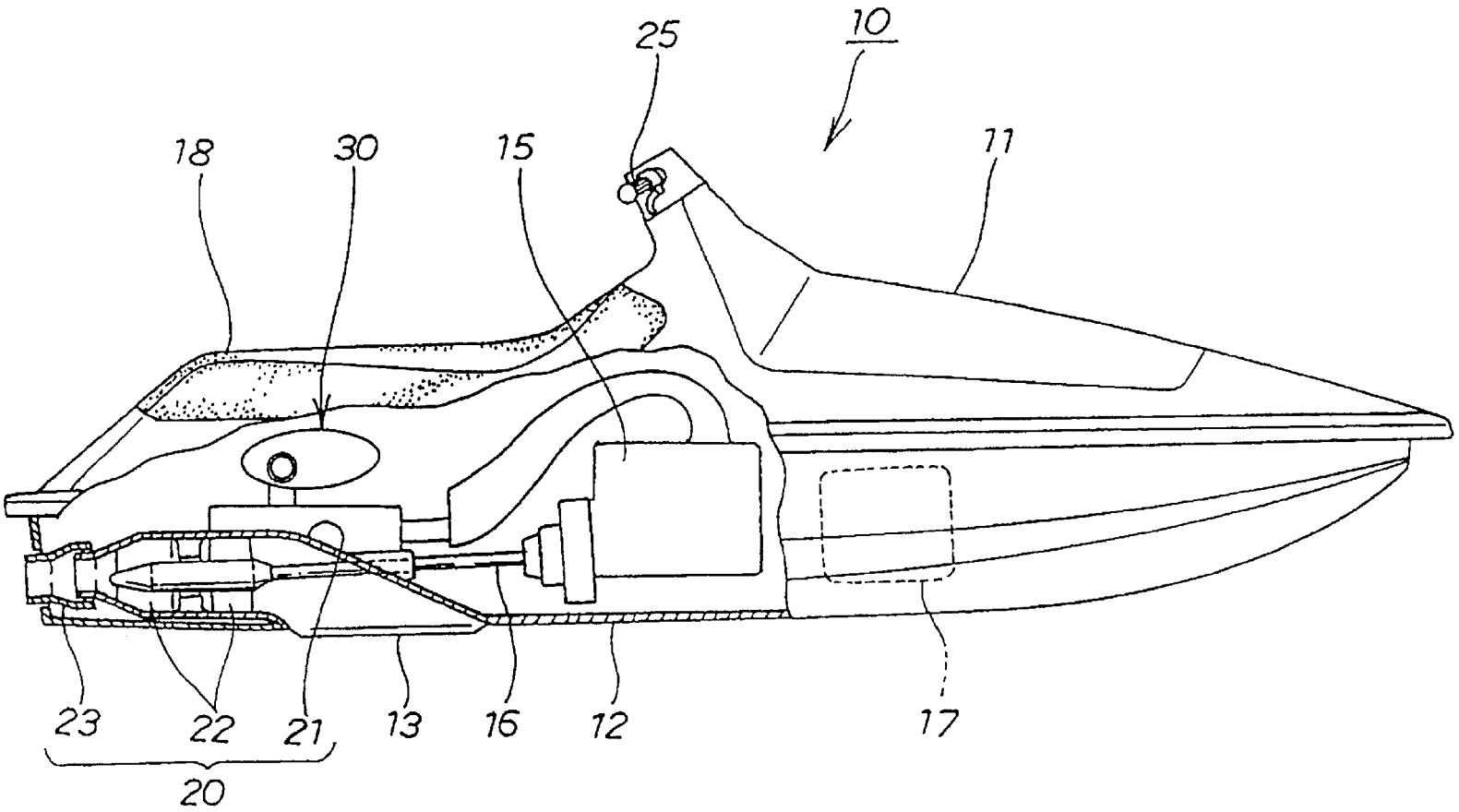
FIG. 1 is a side elevational view of a jet propulsion boat having an exhaust system according to the present invention.

FIG. 1 shows a jet propulsion boat 10 having an engine 15 attached roughly at the center of a hull 11. The engine 15 drives a jet propulsion device 20 which jets water sucked from an opening 13 of a hull bottom 12 rearwardly from the hull 11. A steering handlebar 25 controls a turning direction of the hull 11, and an exhaust system 30 exhausts engine exhaust gas into the water. Numeral 17 designates a fuel tank and numeral 18 designates a seat.

The jet propulsion device 20 includes the following elements: a housing 21 extending rearwardly from the opening 13 of the hull bottom; impellers 22 rotatably attached inside the housing 11 and connected to a drive shaft 16 of the engine 15, and, a nozzle 23 attached to a rear end of the housing 21. The nozzle 23 is pivotable in the turning direction of the hull. The jet propulsion device sucks water from the opening 13 by rotating the impellers 22 and generates propulsion force by jetting the water out of the nozzle 23.

Figure 2:
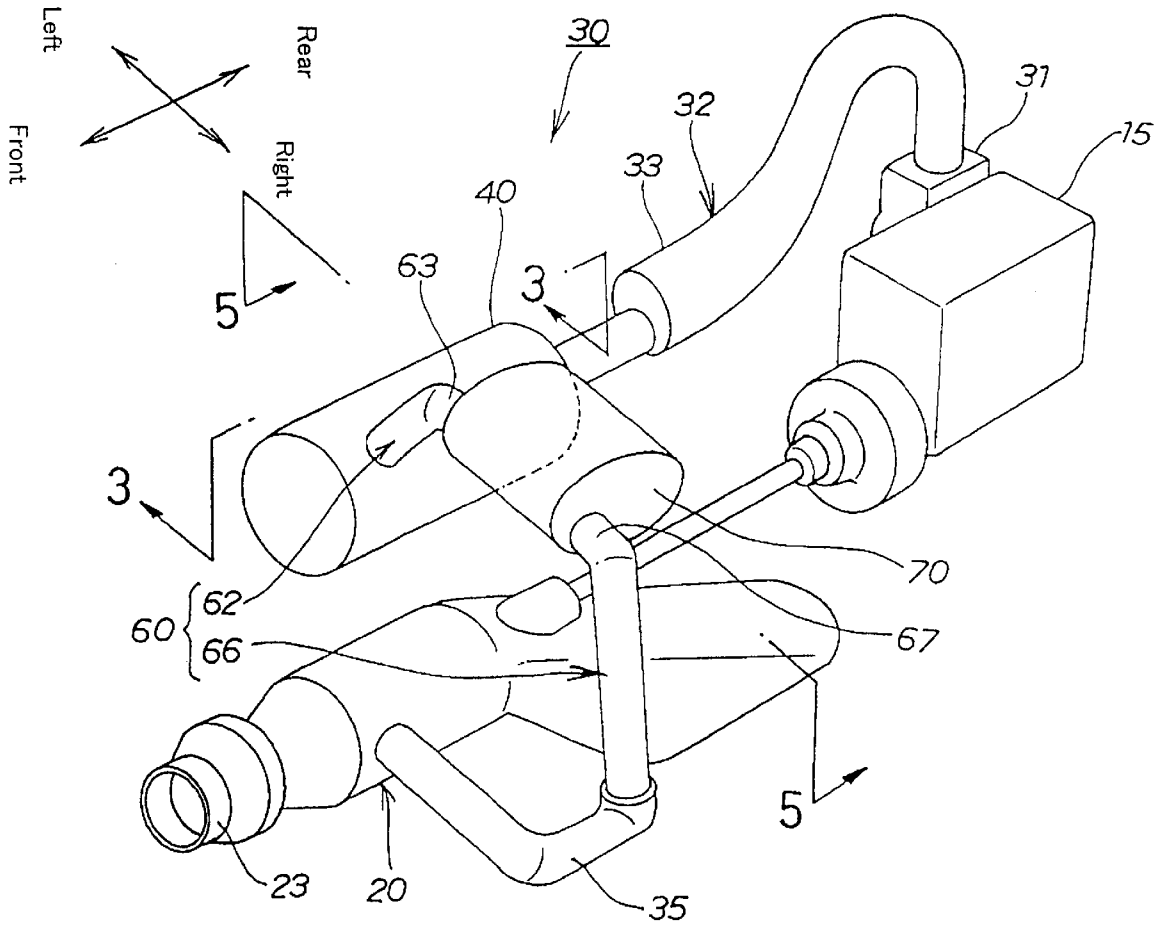
FIG. 2 is a perspective view of the exhaust system according to the present invention.

FIG. 2 shows the exhaust system 30 of the jet propulsion boat. An exhaust pipe 32 is connected to an exhaust manifold 31 of the engine 15. The exhaust pipe 32 connects the engine 15 to a muffler 40. A connecting pipe 60 having an inverse U shape connects one side of an auxiliary muffler 70 to the muffler 40, and another side of the auxiliary muffler 70 to a tail pipe 35. The auxiliary muffler 70 is at a position higher than the exhaust pipe 32.

The exhaust pipe 32 includes an exhaust pipe 33 extending from the exhaust manifold 31 to the muffler 40, and a tail pipe 35 extending rearwardly from an exhaust outlet of the connecting pipe 60.

Connecting pipe 60 includes a left side connecting pipe 62 and a right side connecting pipe 66. The horizontal auxiliary muffler 70 is connected to respective upper end portions 63 and 67 of the left side connecting pipe 62 and the right side connecting pipe 66. When water enters the tail pipe 35, the water is prevented from entering the side of the engine by the connecting pipe 60, and the connecting pipe 60 is generally referred to as water lock pipe.

A detailed explanation of the muffler 40 and the auxiliary muffler 70 follows.

Figure 3:
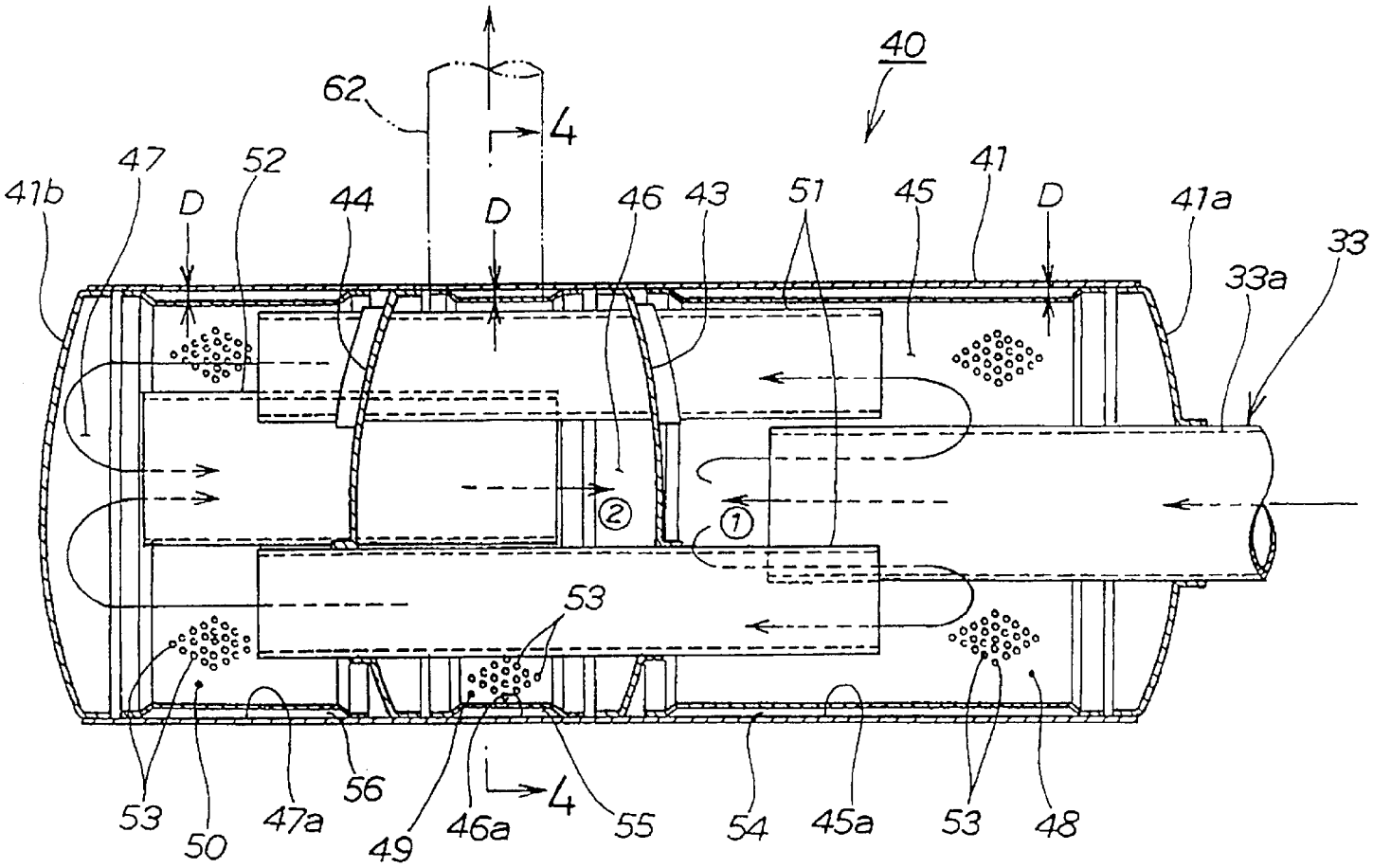
FIG. 3 is a sectional view taken along line 3—3 in FIG. 2.

FIG. 3 is a sectional view taken along a 3—3 line of FIG. 2. The muffler 40 has a cylindrical member 41 which extends along the length of the muffler 40. A front end of the cylindrical member 41 is closed by a front lid 41*a*, and the front lid 41*a* is attached to an exhaust outlet 33*a* of the exhaust pipe 33. A rear end of the cylindrical member 41 is closed by a rear lid 41*b*. A front side expansion chamber 45, an intermediary expansion chamber 46, and a rear side expansion chamber 47 are formed by partitioning the interior of the cylindrical member 41 by a front side partition wall 43 and a rear side partition 44. Punching plates 48, 49 and 50 are respectively attached to inner peripheral walls 45*a*, 46*a* and 47*a* of the respective chambers.

A pair of first inner pipes 51 for guiding exhaust gas from the front side expansion chamber 45 to the rear side expansion chamber 47 are attached to the front and partition walls 43 and 44. A second inner pipe 52 for guiding exhaust gas from the rear side expansion chamber 47 to the intermediary expansion chamber 46 is attached to the side partition wall 44, and an exhaust inlet (not illustrated) of the left side connecting pipe 62 is inserted into the intermediary expansion chamber 46.

The punching plates 48, 49 and 50 of the front side expansion chamber 45, the intermediary expansion chamber 46, and the rear side expansion chamber 47, respectively, include a plurality of holes 53. The punching plates 48, 49 and 50 have a lattice-like shape and are attached to be remote from the inner peripheral walls 45*a*, 46*a* and 47*a* by a constant interval D. The holes 53 in the punching plates 48, 49 and 50 have a diameter "d" at a pitch P.

The following values may be used in the muffler 40. The constant interval D may be 6 mm, the diameter d may be 3 mm, and the pitch may be 5 mm. These values may be varied to achieve differing sound inhibiting capacities.

An explanation of exhaust gas flow in the muffler 40 follows.

The exhaust gas flows from the exhaust pipe 33 to the front side expansion chamber 45, and follows the following path (shown by an arrow 1): the front side expansion chamber 45→ the pair of first inner pipes 51→ the rear side expansion chamber 47→ the second inner pipe 52→ the intermediary expansion chamber (arrow 2). Thereafter, the gas flows to the left side connecting pipe. Exhaust noise is reduced by expanding the exhaust gas in the respective expansion chambers 45, 46 and 47.

Further, the exhaust gas which has flowed into the expansion chambers 45, 46 and 47 first passes through the holes 53 of the punching plates 48, 49 and 50, and flows into spaces 54, 55 and 56 between the punching plates 48, 49 and 50 and the inner peripheral walls 45*a*, 46*a* and 47*a*. Therefore, frequencies provided to the respective spaces interfere with each other at insides of the respective spaces 54, 55 and 56, and the exhaust noise can be reduced. This increases the noise reduction function of the muffler 40.

Figure 4:
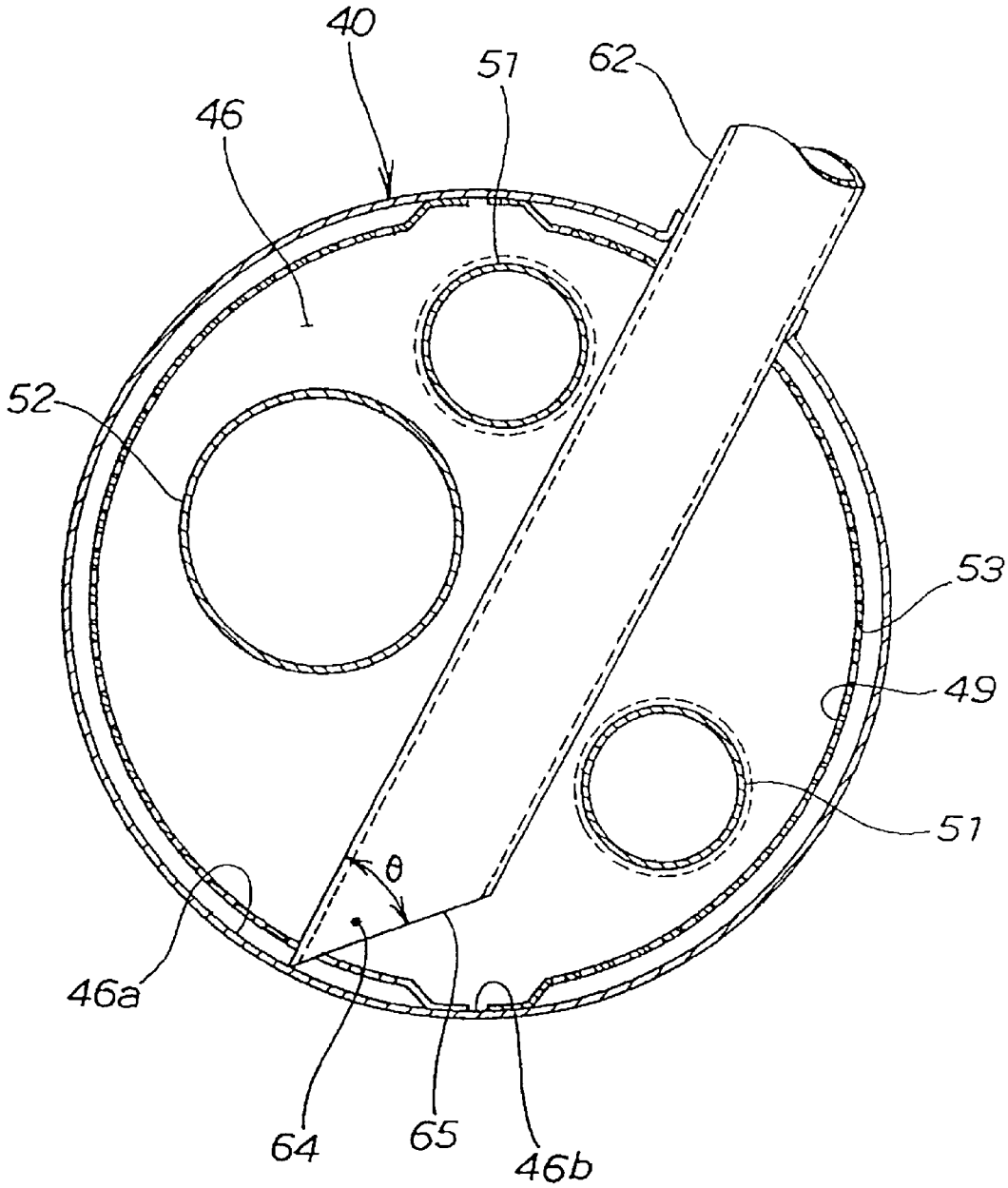
FIG. 4 is a sectional view taken along line 4—4 in FIG. 2.

FIG. 4 is a sectional view taken along a 4—4 line of FIG. 3 FIG. 4 shows the left side connecting pipe 62 connected to the intermediary expansion chamber 46 of the muffler 40.

An opening 65 of a front end portion 64 of the left side connecting pipe is opened in a skewed transverse direction by obliquely cutting the front end portion 64 at an angle θ. Therefore, if the front end portion 64 of the left side connecting pipe 62 is proximate to a bottom portion 46*b* of the inner peripheral wall 46*a* of the intermediary expansion chamber 46 (or, contacting the bottom portion 46*b*), the opening 65 remains separate from the bottom portion 46*b*.

Therefore, the exhaust gas in the intermediary expansion chamber 46 of the muffler 40 smoothly flows from the opening 65 into the left side connecting pipe 62.

Figure 5:
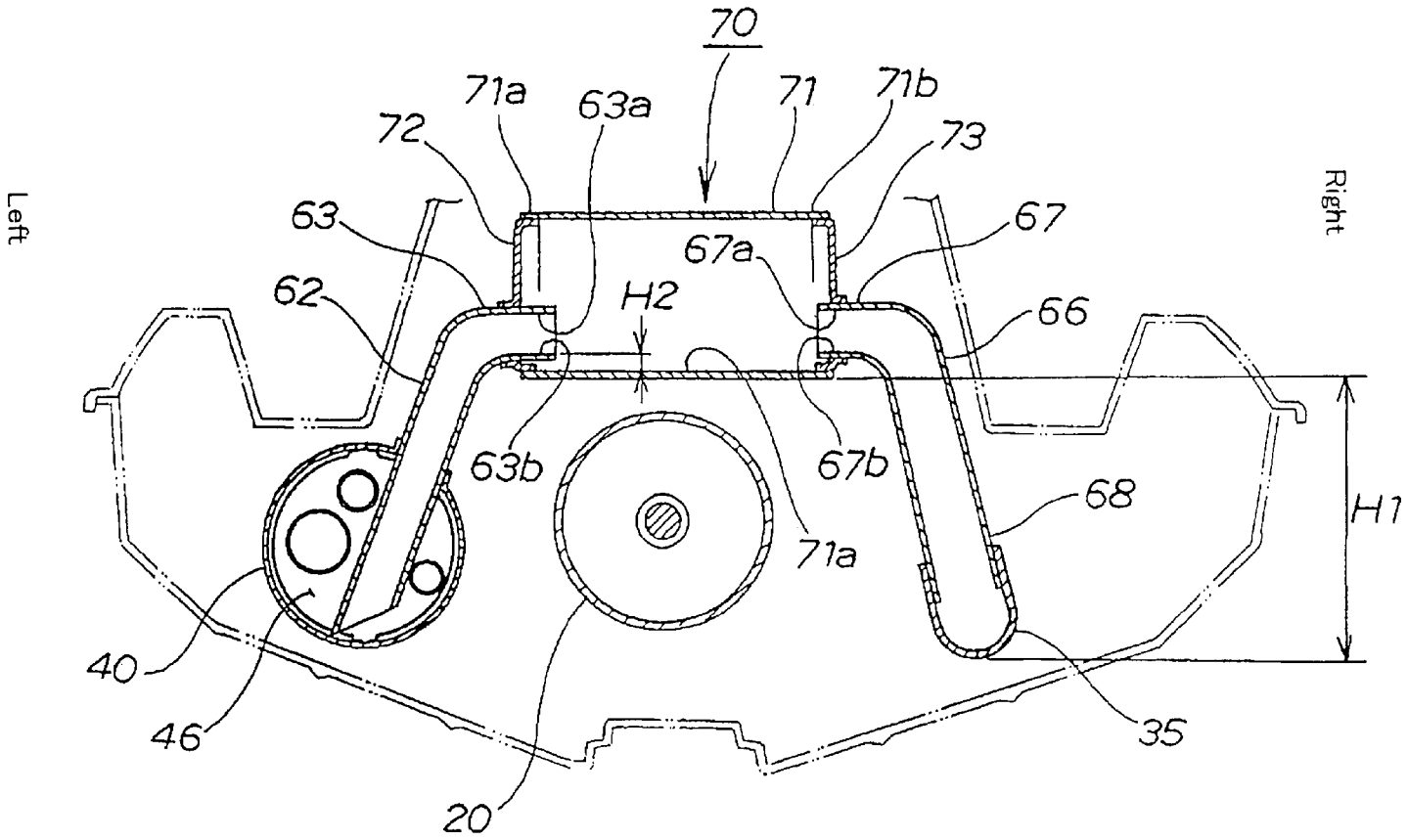
FIG. 5 is a sectional view taken along line 5—5 in FIG. 2.

FIG. 5 is a sectional view taken along a 5—5 line of FIG. 2. The auxiliary muffler 70 is a horizontal elliptical cylinder type. The auxiliary muffler 70 has a cylindrical member 71 extending transversely to the longitudinal axis of the jet propulsion boat 10. The cylindrical member has an elliptical transverse cross section.

The ends 71*a* and 71*b* of the cylindrical member 71 are respectively closed by lid plates 72. The upper end portion 63 of the left side connecting pipe 62 is connected to the left side lid plate 72, and the upper end portion 67 of the right side connecting pipe 66 is connected to the right side lid plate 73.

By attaching the tail pipe 35 to a lower portion 68 of the right side connecting pipe 66 (corresponding to an exhaust outlet of the connecting pipe 60 shown in FIG. 2) the auxiliary muffler 70 can be arranged at a position higher than the tail pipe 35. The difference in height is shown as a predetermined height H1. Therefore, when water enters the tail pipe 35, it does not enter the auxiliary muffler 35.

An opening of the upper end portion 63 of the left side connecting pipe 62 forms an exhaust inlet 63*a* of the auxiliary muffler 70, and an opening of the upper end portion 67 of the right side connecting pipe 66 forms an exhaust outlet 67*a* of the auxiliary muffler 70. The levels of a bottom 63*b* of the exhaust inlet 63*a* and a bottom 67*b* of the exhaust outlet 67*a* are substantially coincident with a level of a bottom 71*a* of the elliptical type cylindrical member 71. The height difference between the levels of the bottoms 63*b* of the exhaust inlet 63*a* and the bottom 67*b* of the exhaust outlet 67*a*, and the bottom 71*a* of the elliptical type cylindrical member 71 can be made as small as H2.

A description of the operation of the exhaust system 30 of the jet propulsion boat 10 follows.

FIGS. 6(*a*) and 6(*b*) are explanatory views of the operation of the exhaust system 30. FIG. 6(*c*) is a comparative example of the operation of an exhaust system. According to FIG. 6(*a*), exhaust gas within the intermediary expansion chamber 46 of the muffler 40 is exhausted via the left side connecting pipe 62, as shown by an arrow 3. At the same time, water 75 stored in the intermediary expansion chambers 46 is sucked from the opening 65 of the left side connecting pipe 62 and exhausted along with the exhaust.

According to FIG. 6(*b*), by sucking the water 75 until a water level of the water 75 is lowered to a lower end height hl of the opening 65, only a very small portion of the water 75 remains in the intermediary expansion chamber 46. Therefore, the water 75 in the intermediary expansion chamber 46 can be exhausted while operating the jet propulsion boat.

As a result, time and labor for draining the water is saved after completing operation of the jet propulsion boat 10. Also, handling of the boat 10 is improved. Further, the noise reduction capacity is not deteriorated by storing the water 75 in the muffler 40 while operating the jet propulsion boat 10.

According to FIG. 6 (*c*), exhaust gas inside a muffler 120 is exhausted into a left side connecting pipe 121 via an opening 122, as shown by an arrow 4. At the same time, water 124 stored inside an intermediary expansion chamber is exhausted from the opening 122 into the left side connecting pipe 121, along with exhaust gas.

However, the opening 122 opens downwardly, and accordingly, when a level of the water 124 is lowered to a height h2 of the opening 122, the water 75 cannot be exhausted. Therefore, a comparatively large amount of the water 75 remains inside of the muffler 120.

As a result, it is necessary to drain the water after operation of the jet propulsion boat, requiring time and labor. Further, the noise reduction capacity is reduced by storing a comparatively large amount of water in the muffler 120.

FIG. 7 is an explanatory view of second operational feature of the exhaust system 30. By flowing exhaust gas from the muffler 40 to the left side connecting pipe 62, as shown by an arrow 5, and by flowing the exhaust gas from the left side connecting pipe 62 into the auxiliary muffler 70, the exhaust gas is expanded within the auxiliary muffler 70, and exhaust noise of the exhaust gas is reduced.

By adding the auxiliary muffler 70 to function with the muffler 40, the noise reduction capacity of exhaust noise can further be increased. In addition, the exhaust gas within the auxiliary muffler 70 is flowed to the right side connecting pipe 66 and is flowed out from the tail pipe 35 into water.

The auxiliary muffler 70 is arranged at a position higher than the tail pipe 35 by the predetermined height H1, and accordingly, even when water enters the tail pipe 35, water is prevented from entering the auxiliary muffler 70.

Even when water is stored in the auxiliary muffler 70, the distance H2 from the levels of the bottom 63*b* of the exhaust outlet 63*a* and the bottom 67*b* of the exhaust outlet 67*a* of the auxiliary muffler 70, to the level of the bottom 71*a* of the elliptical type cylindrical member 71 is reduced. Accordingly, water is flowed out via the left and right connecting pipes 62 and 66 and water stored at the bottom 71*a* of the elliptical type cylindrical member is reduced. As a result, the noise reduction function of the auxiliary muffler 70 is not affected by stored water.

Further, as shown by FIG. 2, two mufflers of the muffler 40 and the auxiliary muffler 70 are attached to the exhaust pipe 32. By making respective attenuating characteristics of the muffler 40 and auxiliary muffler 70 differ from one another, a wide operating region of noise reduction capacity can be achieved.

Although an explanation has been given of an auxiliary muffler having cylindrical member with an elliptical shape cross-section, a circular shape or the like may also be used. Further, although the tail pipe 35 is attached at the outlet side of the connecting pipe 60, the connecting pipe 60 and the tail pipe 35 may be integrally formed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust system for a jet propulsion boat, the exhaust system comprising:

a muffler, the muffler being connected to an exhaust pipe to receive exhaust gases from an engine;

an auxiliary muffler operatively connected to the muffler to receive exhaust gases passing through the muffler;

a tail pipe operatively connected to the auxiliary muffler to receive exhaust gases passing through the auxiliary muffler, wherein the auxiliary muffler is positioned within the exhaust system to suppress entry of water into the auxiliary muffler; and a connecting pipe having a generally inverse U shape, one side of the connecting pipe connecting the auxiliary muffler to the muffler, and another side of the connecting pipe connecting the auxiliary muffler to the tail pipe.

2. The exhaust system of claim 1, wherein the auxiliary muffler is at a level higher than that of an exhaust outlet of the exhaust pipe.

3. The exhaust system of claim 1, wherein the auxiliary muffler is at a level higher than that of the muffler.

4. The exhaust system of claim 1, wherein the auxiliary muffler is connected to the muffler by a connecting pipe, the connecting pipe extending generally upwardly from the muffler to the auxiliary muffler.

5. The exhaust system of claim 1, wherein the auxiliary muffler is connected to the tail pipe by a connecting pipe, the connecting pipe extending generally downwardly from the auxiliary muffler to the tail pipe.

6. The exhaust system of claim 1, wherein the auxiliary muffler is at a top portion of the connecting pipe.

7. The exhaust system of claim 1, wherein the auxiliary muffler includes a generally horizontally disposed body, each end of the body being closed by a lid.

8. The exhaust system of claim 7, wherein the auxiliary muffler has a longitudinal axis, and the muffler has a longitudinal axis that is nonparallel to that of the auxiliary muffler.

9. The exhaust system of claim 8, wherein the axis of the auxiliary muffler is substantially perpendicular to that of the muffler.

10. The exhaust system of claim 8, wherein the body of the auxiliary muffler is generally cylindrical in cross section.

11. The exhaust system of claim 7, wherein the auxiliary muffler includes an exhaust inlet and an exhaust outlet, a bottom surface of the horizontally disposed body being substantially at the same level as a bottom of the exhaust inlet and the exhaust outlet.

12. The exhaust system of claim 7, wherein the muffler is divided into three chambers by two partition walls, the exhaust pipe exhausting gases into a chamber at one end of the muffler.

13. A jet propulsion boat comprising:

a hull;

a steering mechanism;

an engine;

a jet propulsion device operatively connected to the engine by a drive shaft to derive propulsion power therefrom; and an exhaust system connected at a first end to the engine and at a second end to the jet propulsion device, the exhaust system including, a muffler, the muffler being connected to an exhaust pipe to receive exhaust gases from the engine, an auxiliary muffler operatively connected to the muffler to receive exhaust gases passing through the muffler, a tail pipe operatively connected to the auxiliary muffler to receive exhaust gases passing through the auxiliary muffler, wherein the auxiliary muffler is positioned within the exhaust system to suppress entry of water into the auxiliary muffler, wherein the auxiliary muffler is connected to the muffler by a connecting pipe, a first part of the connecting pipe extending generally upwardly from the muffler to the auxiliary muffler, and wherein the auxiliary muffler is connected to the tail pipe by a second part of the connecting pipe, the second part of the connecting pipe extending generally downwardly from the auxiliary muffler to the tail pipe; and the tail pipe is connected to the jet propulsion device so that exhaust gases passing through the tail pipe are directed through the jet propulsion device during operation of the jet propulsion boat.

14. A jet propulsion boat comprising:

a hull;

a steering mechanism;

an engine;

a jet propulsion device operatively connected to the engine by a drive shaft to derive propulsion power therefrom; and an exhaust system connected at a first end to the engine and at a second end to the jet propulsion device, the exhaust system including, a muffler, the muffler being connected to an exhaust pipe to receive exhaust gases from the engine, an auxiliary muffler operatively connected to the muffler to receive exhaust gases passing through the muffler, a tail pipe operatively connected to the auxiliary muffler to receive exhaust gases passing through the auxiliary muffler, wherein the auxiliary muffler is positioned within the exhaust system to suppress entry of water into the auxiliary muffler, and wherein the auxiliary muffler is connected to the muffler and to the tail pipe by a connecting pipe, the auxiliary muffler and the connecting pipe extending over the jet propulsion device, with the auxiliary muffler at a top portion of the connecting pipe.

15. The jet propulsion boat of claim 14, wherein the auxiliary muffler is at a level higher than that of an exhaust outlet of the exhaust pipe.

16. The jet propulsion boat of claim 14, wherein the auxiliary muffler is connected to the muffler by a first part of the connecting pipe which extends generally upwardly from the muffler to the auxiliary muffler.

17. The jet propulsion boat of claim 14, wherein the auxiliary muffler is disposed above a part of the jet propulsion device.

18. The jet propulsion boat of claim 17, wherein the muffler has a longitudinal axis and the auxiliary muffler has a longitudinal axis that is nonparallel to that of the muffler, the auxiliary muffler extending substantially perpendicularly to a longitudinal axis of the drive shaft.

* * * * *